US007405191B2

(12) United States Patent
Zhu et al.

(10) Patent No.: US 7,405,191 B2
(45) Date of Patent: Jul. 29, 2008

(54) MULTI_USE FABRIC CARE ARTICLE AND METHOD

(75) Inventors: Yun Peng Zhu, Fair Lawn, NJ (US); Feng-Lung Gordon Hsu, Tenafly, NJ (US); Diane Wolf, Bridgewater, NJ (US)

(73) Assignee: Unilever Home & Personal Care USA Division of Conopco, Inc., Greenwich, CT (US)

( * ) Notice: Subject to any disclaimer, the term of this patent is extended or adjusted under 35 U.S.C. 154(b) by 0 days.

(21) Appl. No.: 11/748,517

(22) Filed: May 15, 2007

(65) Prior Publication Data

US 2007/0203044 A1 Aug. 30, 2007

Related U.S. Application Data

(63) Continuation of application No. 11/109,110, filed on Apr. 19, 2005, now abandoned.

(51) Int. Cl.
*C11D 17/04* (2006.01)

(52) U.S. Cl. ..... 510/519

(58) Field of Classification Search ..... 510/519
See application file for complete search history.

(56) References Cited

U.S. PATENT DOCUMENTS

| | | | | |
|---|---|---|---|---|
| 3,634,947 | A | 1/1972 | Furgal | 34/60 |
| 3,686,025 | A | 8/1972 | Morton | 117/140 |
| 3,736,668 | A | 6/1973 | Dillarstone | 34/60 |
| 3,870,145 | A | 3/1975 | Mizuno | 206/84 |
| 3,948,387 | A | 4/1976 | Haertle | 206/84 |
| 4,004,685 | A | 1/1977 | Mizuno et al. | 206/0.5 |
| 4,014,105 | A | 3/1977 | Furgal et al. | 34/12 |
| 4,014,432 | A | 3/1977 | Clothier et al. | 206/0.5 |
| 4,041,205 | A * | 8/1977 | Compa et al. | 428/220 |
| 4,053,992 | A | 10/1977 | Furgal | 34/60 |
| 4,098,937 | A * | 7/1978 | Mizuno et al. | 428/68 |
| 4,149,977 | A | 4/1979 | Morganson et al. | 252/8.8 |
| 4,170,678 | A | 10/1979 | Urfer et al. | 428/124 |
| 4,254,139 | A | 3/1981 | Hendrickson et al. | 428/283 |
| 4,532,719 | A | 8/1985 | Davies et al. | 34/12 |
| 4,891,388 | A | 1/1990 | Graiver et al. | 521/64 |
| 4,891,389 | A | 1/1990 | Graiver et al. | 521/64 |
| 5,004,610 | A | 4/1991 | Osborne et al. | 424/448 |
| 5,342,623 | A | 8/1994 | Enscore et al. | 424/448 |
| 6,046,155 | A | 4/2000 | Trinh et al. | 510/516 |
| 6,133,226 | A | 10/2000 | Knowlton et al. | 510/520 |
| 2003/0196348 | A1 | 10/2003 | Hagemann et al. | 34/597 |
| 2003/0199416 | A1 | 10/2003 | Fry et al. | 510/327 |
| 2003/0199417 | A1 | 10/2003 | Fry et al. | 510/327 |
| 2003/0213145 | A1 | 11/2003 | Hagemann et al. | 34/597 |

FOREIGN PATENT DOCUMENTS

WO 97/26316 7/1997

OTHER PUBLICATIONS

EP Search Report in an EP application EP 06 07 5728.

* cited by examiner

*Primary Examiner*—John R Hardee
(74) *Attorney, Agent, or Firm*—Rimma Mitelman

(57) ABSTRACT

A fabric care article made of solid or semi-solid matrix of materials for repetitive or multiple use in a machine drying apparatus such as a tumble dryer. The matrix includes a structuring agent comprising a filler structuring agent and a polymeric structuring agent. The filler structuring agent comprises about 0.2 % to about 10% and the polymeric structuring agent comprises about 0.5 to about 20% by weight of the composition. The matrix further includes up to about 25% of an anionic soap surfactant, about 10% to about 60% of free fatty acid, and about 1% to about 50% of a non-ionic, but is substantially free from cationic surfactant. When the fabric care article is used up, it simply disappears, indicating to a user that the article needs to be replenished.

17 Claims, No Drawings

MULTI_USE FABRIC CARE ARTICLE AND METHOD

This is a continuation of U.S. patent application Ser. No. 11/109,110, filed Apr. 19, 2005, now abandoned.

FIELD OF THE INVENTION

The present invention relates to a fabric care article made of a solid or semi-solid matrix of materials for multiple use in a machine drying apparatus such as a tumble dryer.

BACKGROUND OF THE INVENTION

Uniform distribution of conditioning agent in a tumble dryer to achieve effective contact thereof with the fibrous materials of the washed fabrics in a convenient manner is not easily attained. The risk of, for example, spotting or staining, due to local application of excess conditioning agent may be significant. The use of conditioning articles, generally comprising a base or substrate, which may be form-retaining or flexible, coated and/or impregnated with conditioner has been widely used. In use, the conditioner is removable to the fabrics but the staining may be severe. For example, stains developed due to the contacting of cationic conditioning agents, e.g. quaternary ammonium salts, with materials containing color bodies or heavy metal ions such as ferrous or ferric ion may be removable, if at all, only by dry cleaning.

Reusable permeable dispensers for dispensing solid or semi-solid fabric-conditioning agents which can either be attached to the dryer drum or tumbled loosely in the dryer have been developed. For example, see U.S. Pat. Nos. 3,870,145 (Mizuno); 3,948,387 (Haertle); 4,004,685 (Mizuno, et al.); and 4,014,432 (Clothier, et al.).

The present invention is based on the discovery that a fabric care composition may be designed in such a way as to not require a dispenser. The choice of specific components in specific amounts unexpectedly results in a solid mass matrix that does not require a dispenser while being capable of controlled delivery in an automatic machine tumble dryer. When the fabric care article is used up, it simply disappears, indicating to a user that the article needs to be replenished.

SUMMARY OF THE INVENTION

The present invention meets an unmet need left by prior art for a fabric care article comprised of a solid or semi-solid matrix having a unique fabric care composition (substantially free from cationic surfactant) and a method for multiple use thereof in a machine drying apparatus such as a tumble dryer. A tumble dryer typically includes a heat source, which may be electric, gas, or other, and is provided with a rotating drum and an exhaust. The fabric care composition includes:

(a) a structuring agent comprising a filler structuring agent and a polymeric structuring agent; where the filler structuring agent comprises about 0.2% to about 10% and the polymeric structuring agent comprises about 0.5 to about 20% by weight of the composition;

(b) up to about 25% of an anionic surfactant comprising soap;

(c) about 10% to about 60% of free fatty acid, which preferably has a melting point of about 10 deg. C. to about 65 deg. C.; and (d) about 1% to about 50% of a non-ionic material.

The filler structuring agent is a non-woven fabric which may be polyester, polyethylene, polypropylene, cellulose, and mixtures thereof. The polymeric structuring agent may be made of polyamides, block copolymers of ethylene oxide and propylene oxide having hydrophilic and lypophilic end groups, alkyl phenol polylower alkylene oxide lower alkanols, polymers of lower alkylene glycols, polyalkylene glycol ethers of higher fatty alcohols and poly alkylene glycol esters of higher fatty acids, polyoxyalkylenated fatty alcohols, polyurethanes, polylactide, polyacrylamide, polyacrylates, polyethylene, polyvinyl alcohol, and mixtures thereof.

DETAILED DESCRIPTION OF THE INVENTION

The present invention relates to a fabric care article comprised of a solid or semi-solid matrix having a unique fabric care composition and a method for multiple use thereof in a machine drying apparatus such as a tumble dryer. A tumble dryer typically includes a heat source, which may be electric, gas, or other, and is provided with a rotating drum and an exhaust. The fabric care composition includes:

(a) a structuring agent comprising a filler structuring agent and a polymeric structuring agent; where the filler structuring agent comprises about 0.2% to about 10% and the polymeric structuring agent comprises about 0.5 to about 20% by weight of the composition;

(b) up to about 25% of an anionic surfactant comprising soap;

(c) about 10% to about 60% of free fatty acid; and (d) about 1% to about 50% of a non-ionic material.

The matrix is a consolidated three-dimensional mass of the combined materials, which may be cast into a bar of about 10 to about 30 grams for multiple use in a tumble dryer, preferably about ten uses or dryer cycles. The matrix is solid or semi-solid at ambient temperature of about 20 to about 25 deg. C. The bar will soften when heated in a laundry dryer. The product is delivered to the fabrics by directly contacting/wiping mechanism when the temperature and the humidity in the dryer reach a certain point. The product is designed to thereby avoid staining. The solid form of the product may enhance its aesthetics as it may be shaped into different forms. When the fabric care article is used up, it simply disappears, indicating to a user that the article needs to be replenished.

No substrate, spreading agent, or package is required, thereby avoiding the cost of the material, the cost of the process of applying fabric care materials thereon, and the cost to the environment. Optionally, the fabric care article further includes a package, which retains the matrix and permits delivery of the matrix composition onto fabrics in a tumble dryer. For example, the package may include a reservoir for storing the fabric care composition. The package also controls the amount of the materials delivered onto the fabrics per cycle of the tumble dryer. Further, optionally, the package may be provided with a delivery window, which may adsorb or absorb the matrix materials during the operation of the tumble dryer. The absorptive material controls delivery of the matrix materials onto the fabrics. The absorptive material may be a non-woven material, preferably from polyester, polypropylene, cellulose, and mixtures thereof. The package may be preferably mounted on a dryer door or on a leading edge of one of the dryer vanes, or may be kept inside a dryer until it disappears.

The term "multiple use" is used herein in its ordinary meaning to refer to re-use during multiple tumble drying cycles of a machine drying apparatus such as a tumble dryer. Preferred number of multiple cycles is about 3 to about 50 drying cycles, more preferred about 3 to about 25 drying cycles, most preferred about 3 to about 10 drying cycles.

The term "comprising" is used herein in its ordinary meaning and means including, made up of, composed of, consisting and/or consisting essentially of. In other words, the term is defined as not being exhaustive of the steps, components, ingredients, or features to which it refers.

Except in the operating and comparative examples, or where otherwise explicitly indicated, all numbers in this description indicating amounts or ratios of material or conditions of reaction, physical properties of materials and/or use are to be understood as modified by the word "about".

As used herein, the term "substantially free of" means that the amount of matter to which it refers will be limited to less than about 5% of the composition, preferably about 1% or less.

Fabric Care Composition

The fabric care composition improves fabric properties. The inventive composition is described herein below and is present in multi-use reusable form.

Structuring Agent

The fabric care composition includes a structuring agent which is made up of filler structuring agent or material and polymeric structuring agent. Not wishing to be bound by any theory, it is believed that the structuring agent mainly plays two functions; one is pure structuring and another is to control delivery.

Filler Structuring Agent

Filler structuring agent may be made of non-woven fabric. Non-woven fabric may be made of polyester, polyethylene, polypropylene, cellulose, and mixtures thereof. This agent also serves as an absorbtive material.

The Nonwovens are a sheet, web, or bat of natural and/or man-made fibers or filaments, excluding paper, that have not been converted into yarns, and that are bonded to each other by any of several means.

a) Adding an adhesive;
b) Thermally fusing the fibers or filaments to each other or to the other meltable fibers or powders;
c) Fusing fibers by first dissolving, and then re-solidifying their surfaces;
d) Creating physical tangles or tuft among the fibers;
e) Stitching the fibers or filaments in place; and/or
f) Combination of the above.

There are dry-laid, wet-laid, melt-blown, spunbound, and nano-fiber non-wovens. Preferred are air-laid non-wovens with or without binder. More preferably air-laid non-wovens have a density of about 2 to about 15 Ounces per square yard, a Nominal thickness of about ⅛" to about 1" (inch). Pore size or porosity can be characterized by ppi (pores per linear inch). Preferred porosity is about 10 ppi to about 150 ppi. More preferred pore size is about 20 to about 100 ppi.

Filler structuring agent comprises about 0.2% to about 10% of the solid or semi-solid matrix that makes up the fabric care article of the present invention.

Polymeric Structuring Agents

Polymeric structuring agents increase the overall viscosity of the matrix composition and control the release of matrix materials from the solid block in the tumble dryer. The matrix active other than the structuring agents are in a melted state at high temperature of the tumble dryer in operation. Without wishing to be bound by theory, it is believed that, without the polymeric structuring agent, the fabric care composition would be used up in a single tumble dryer cycle. Accordingly, inclusion of polymeric structuring agents is important for the multi-use fabric care article of the present invention. According to the present invention, a controlled amount of fabric care materials is delivered to the fabrics in each cycle of the tumble dryer. The Polymeric Structuring Agents also help maintain the integrity of the fabric care article.

Polymeric structuring agents include nonionic surface materials, such as polyamides (e.g. high fatty acid alkanolamides such as coconut monoethanolamide), block copolymers of ethylene oxide and propylene oxide having hydrophilic and lypophilic end groups, alkyl (preferably middle alkyl)phenol polylower alkylene oxide lower alkanols, polymers of lower alkylene glycols (e.g. polyethylene glycol), polyalkylene glycol ethers of higher fatty alcohols and poly alkylene glycol esters of higher fatty acids, polyoxyalkylenated fatty alcohol, polyurethanes, polylactide, polyacrylamide, polyacrylates, polyethylene, polyvinyl alcohol, and mixtures thereof. All of the polymeric structuring agent is solid at room temperature, preferably having a melting point of about 35° C. to about 90° C.

Some of the structuring agents, preferably polyalkylene glycol ethers of higher fatty alcohols and poly alkylene glycol esters of higher fatty acids, polyoxyalkylenated fatty alcohol, polyethylene glycols, can help control delivery at lower temperature.

Polyamides are available under the UNICLEAR 100 brand from Arizona Chemical Co., as well as Sylvaclear AF1900, Sylvaclear A200 gellants.

Anionic Surfactants

In order to attain a level of fabric softening, the inventive fabric care compositions contain up to about 25% anionic surfactant by weight of the composition. Not wishing to be bound by theory, it is believed that anionic surfactants provide structuring, lubricity, and/or anti-static benefits.

The anionic surfactants used in this invention can be any anionic surfactant that is preferably water soluble. "Water soluble" surfactants are, unless otherwise noted, here defined to include surfactants which are soluble or dispersible to at least the extent of 0.01% by weight in distilled water at 25° C. "Anionic surfactants" are defined herein as amphiphilic molecules with an average molecular weight of less than about 10,000, comprising one or more functional groups that exhibit a net anionic charge when in aqueous solution at the normal wash pH of between 6 and 11. It is preferred that at least one of the anionic surfactants used in this invention be an alkali or alkaline earth metal or amine, alkanolamine salt of a natural or synthetic fatty acid containing between 4 and 30 carbon atoms. It is especially preferred to use a mixture of carboxylic acid salts with one or more other anionic surfactants. Another important class of anionic compounds are the water soluble salts, particularly the alkali metal salts, of organic sulfur reaction products having in their molecular structure an alkyl radical containing from about 6 to 24 carbon atoms and a radical selected from the group consisting of sulfonic and sulfuric acid ester radicals.

Carboxylic Acid Salts $$R^1COOM$$

where $R^1$ is a straight or branched, saturated or unsaturated alkyl of 4 to 30 carbon atoms or hydroxyl alkyl group of 10 to 30 carbon atoms and M is a solubilizing cation. The alkyl group represented by $R^1$ may represent a mixture of chain lengths and may be saturated or unsaturated, although it is preferred that at least two thirds of the $R^1$ groups have a chain length of between 8 and 18 carbon atoms. Nonlimiting examples of suitable alkyl group sources include the fatty acids derived from coconut oil, tallow, tall oil and palm kernel oil. For the purposes of minimizing odor, however, it is often desirable to use primarily saturated carboxylic acids. Such materials are available from many commercial sources, such as Uniqema (Wilmington, Del.) and Twin Rivers Technologies (Quincy, Mass.). The solubilizing cation, M, may be any cation that confers water solubility to the product, although monovalent moieties are generally preferred. Examples of acceptable solubilizing cations for use with this invention include alkali metals such as sodium and potassium, which are particularly preferred, and amines such as triethanolammonium, ammonium and morpholinium. Although, when used, the majority of the fatty acid should be incorporated into the formulation in neutralized salt form, it is often preferable to leave a small amount of free fatty acid in the formulation, as descussed in more detail herein below, as this can aid in the maintenance of product viscosity.

Preferably, anionic surfactants for purposes of the present invention include water soluble $C_{12}$, $C_{16}$, and $C_{18}$ soap, or mixtures thereof. Fatty acid salts or their mixtures also help in structuring.

For example, sodium soap of tallow oil, coconut oil (mainly $C_{1-2}$ saturated with some $C_{14}$), lauric acid ($C_{12}$ saturated), palmitic acid ($C_{16}$ saturated), stearic acid ($C_{18}$ saturated), tallow oil (mainly $C_{16}$-$C_{18}$, mixture of saturated and unsaturated), ricinoleic acid, hydroxystearic acid, and mixtures thereof.

Free Fatty Acid

Free fatty acid in the formulation can aid in the maintenance of product viscosity. Not wishing to be limited by theory, it is believed that free fatty acid can function as a crispy/or non-tacky, release agent. In addition, fatty acid can control hygroscopisity.

Free fatty acid, for purposes of the present invention, is a $C_4$ to $C_{30}$, preferably a $C_8$ to $C_{24}$, saturated or unsaturated fatty acid or mixtures thereof. Free fatty acid for purposes of the present invention has a Melting Point of about 10 deg. C. to about 65 deg. C.

Preferred fatty acids include, stearic acid, hardened tallow fatty acid (available under the tradename Pristerene from Uniqema), ricinoleic acid, hydroxystearic acid, and mixtures thereof. The composition includes about 10% to about 60% of free fatty acid, and more preferably about 20% to about 50% by weight of the composition.

Non-ionic Material

A nonionic material is present in order to improve control of the melting temperature of the composition or at least to affect the temperature at which the composition flows. Nonionic surfactants are also useful solubilizers for any perfume that may present in the matrix composition. Nonionic surfactants are also useful as anti-static agents, acting by adsorbing or maintaining moisture, Nonionic materials include ethoxylated alcohols and alkylphenols having from about 12 to about 22 EO groups (i.e., solid type), tertiary phosphine oxides tertiary amine oxides, and combinations thereof.

Preferably, the non-ionic material is solid at ambient temperature.

The non-ionic material and the anionic surfactant are water soluble components of the composition. The non-ionic material is present in the inventive compositions at about 1% to about 50% by weight.

The fabric care composition of the present invention reduces static electricity carried by the fabrics. The matrix is substantially free of cationic surfactant. The ratio of anionic surfactant to fatty acid to non-ionic material is preferably about 1/1.5/1 to about 1/10/2 by the weight, preferably about 1/1.5/1 to about 1/2.5/2, in order to provide anti-static benefits that would otherwise be achieved by use of cationic surfactants.

Optional Components

In addition to the principal conditioning compounds, other components may also be included. For example, perfumes, brighteners, bactericides, solvents, thickening or hardening agents, stabilizers and other materials may be incorporated in the fabric care compositions. In some cases, small quantities of water may be present, especially when the components form hydrates. The types and proportion of the various adjuvants used will be chosen to make them non-interfering with the operations of the principal fabric care compounds. Inorganic fillers, preferably silicate, fused, precipitated fine silica, and/or clay may be incorporated.

Where the matrix materials are cast into a bar, additives may be used to improve bar-forming characteristics.

In Use

Laundered damp fabric is loaded into a machine clothes tumble dryer. The dryer is activated causing relative movement between the fabric care article and the laundry. The combination of heat, moisture and impact contact between the article and the laundry effect the release of fabric care agents onto the tumbling fabric. Ordinarily, there will be about 5 to about 50 changes of drying air in the dryer drum per minute and the air temperature will be from about 10 to 100° C. and preferably from 50 to 80° C. The drum rotates at about 20 to 100 and preferably 4 to 80 revolutions per minute. The laundry load usually averages from 4 to 12 pounds and will occupy from 10 to 70% of the effective drying volume of the dryer. Drying generally takes from 5 minutes to 2 hours and usually from 20 to 60 minutes. Synthetic fabrics such as nylon and polyester ordinarily require only 3 to 10 minutes while permanent press materials usually require from 10 to 30 minutes.

Optionally, the fabric care article of the present invention may be provided with liquid permeable absorptive sheet material for containing and dispensing the composition of the fabric care article. For example, a package including absorptive sheet material may be provided with a reservoir space for receiving the care article. The package may be a sachet of flexible sheet material. Suitable materials include paper, nonwoven fabrics, plastic films, and laminates of these. The care composition can wick through the fabric to the surface by capillary action. The fabric care article, after use, may be left in place and re-charged when necessary with a selected amount of fabric care agents prior to subsequent use or re-use.

The multiple use fabric care article is generally sufficient for at least twenty cycles of a clothes tumble dryer, preferably about ten drying cycles with 50 min to 60 min. each drying cycle. About 0.8 g to about 2 grams of fabric care active is uniformly deposited on the clothes in each cycle.

The following examples are given for purposes of illustration only and are not intended to limit the invention. Parts are by weight unless otherwise indicated.

EXAMPLES

The following raw materials were used in the Examples.

TABLE 1

| Trade name | Descripton |
|---|---|
| Neodol 25-12 | $C_{12}$-$C_{15}$ 12-EO Ethoxylated fatty alcohol, Shell Chemical Co., Texas (non-ionic) |
| Surfonic L24-22 | $C_{12}$-$C_{14}$ 22-EO Ethoxylated linear fatty alcohol, Huntsman Co., Texas (non-ionic) |
| Uniclear 100 | Polyamide Resin, Arizona Chemical (polymeric structuring agent) |
| PEG 8000 | Polyethylene glycol, Dow Chemical Co., Midland, Michigan |
| Non-woven | Polyester Air-laid, All 6 Denier-20% Resin, Karlee Corporation |

The following procedure was used to make the fabric care compositions according to the present invention.

Fatty acid and nonionic surfactant are added and mixed together in a metal container. After the mixture is melted, addition of an alkali to make fatty acid salt in situ. The mixing is continued until the mixture is clear. Then, a structuring agent can be added, and the mixing is kept until the structuring agent is dissolved. At last miscellaneous additives such as fragrance, plasticizers are added to complete the composition. A certain amount of the composition is poured into a mold where a non-woven in the form of a sheet or fiber form is placed at a ratio of composition to nonwoven of about 100:2, and a solid fabric composition is obtained after cooling down.

Example 1

Compositions according to the present invention are presented in the Table below.

TABLE 2

| | A | B | C |
|---|---|---|---|
| Surfonic L1214-22 | 25.0 | — | — |
| C1216EO12 | — | 25.6 | 34.4 |
| Stearic acid | 65.0 | 63.9 | 54.1 |
| Uniclear 100 | — | — | 1.2 |
| KOH | 4.0 | 4.1 | 3.4 |
| H2O | 2.2 | 2.3 | 2.0 |
| Miscellaneous | to 100.0 | to 100 | to 100 |

The compositions were tested in Tumble dryer over 5 cycles as shown in the Table below. About a 10 g solid matrix of the inventive compositions A, B and C were placed on the door. The amount of product delivered onto fabrics in each cycle was determined and is shown in the Table below.

TABLE 3

| Composition | Cycle 1 | Cycle 2 | Cycle 3 | Cycle 4 | Cycle 5 | Average | STDEV |
|---|---|---|---|---|---|---|---|
| A | 1.95 | 1.13 | 0.80 | 1.61 | 1.16 | 1.33 | 0.45 |
| B | 1.96 | 1.45 | 1.37 | 1.00 | 0.81 | 1.32 | 0.45 |
| C | 1.85 | 0.91 | 1.28 | 1.19 | 1.53 | 1.35 | 0.36 |

Deposition was at about 0.8 g to about 2 g/cycle. The Results show that a uniform amount or dosage of fabric care actives was dispensed in each load placed in the dryer. The Average delivery is about 1.33 g and its standard deviation is about 0.40 g every drying cycle. No staining was observed.

Example 3

A fabric care matrix having a composition shown in the Table below was prepared according to the present invention.

TABLE 4

| | D |
|---|---|
| C1216EO12 | 33.9 |
| Stearic acid | 54.8 |
| KOH | 3.4 |
| PEG8000 | 1.0 |
| Fragrance | 5.0 |
| H2O | 1.9 |
| | 100.0 |

Two samples were made with the above composition, but one sample was made with non-woven, and another was made without nonwoven. The samples contain 20 g of the composition.

Below are the delivery data in drying cycle. It is clear that the sample without non-woven delivered most of the actives in the first drying cycle, while the sample with non-woven had a much better controlled-delivery of the actives over the multiple drying cycle.

TABLE 5

| Composition | Cycle 1 | Cycle 2 | Cycle 3 | Cycle 4 | Cycle 5 | Average | STDEV |
|---|---|---|---|---|---|---|---|
| D (Nonwoven) | 1.06 | 1.25 | 0.9 | 0.79 | 0.84 | 0.97 | 0.19 |
| D (0 Nonwoven) | 14.11 | 2.98 | 0.31 | | | | |

While the present invention has been described herein with some specificity, and with reference to certain preferred embodiments thereof, those of ordinary skill in the art will recognize numerous variations, modifications and substitutions of that which has been described which can be made, and which are within the scope and spirit of the invention. It is intended that all of these modifications and variations be within the scope of the present invention as described and claimed herein, and that the inventions be limited only by the scope of the claims which follow, and that such claims be interpreted as broadly as is reasonable. Throughout this application, various publications have been cited. The entireties of each of these publications are hereby incorporated by reference herein.

What is claimed is:

1. A process of making a cast matrix solid or semi-solid multiple use fabric care article for a tumble dryer, the process comprising (a) mixing up to about 25% of an anionic surfactant comprising soap, from about 10% to about 60% of free fatty acid, from about 1% to about 50% of a nonionic material, and from about 0.5% to about 10% polymeric structuring agent, to obtain a mixture;

(b) pouring the mixture into a mold where from about 0.2% to about 10% of a filler non-woven structuring agent in the form of a sheet or fiber form is also placed, to obtain the fabric care article.

2. The process of claim 1, wherein said anionic surfactant and said non-ionic material are water soluble.

3. The process of claim 1, wherein said fatty acid comprises a $C_8$ to $C_{24}$ saturated or unsaturated fatty acid and mixtures thereof.

4. The process of claim 1, wherein said fatty acid has Melting Point of about 10 deg. C. to about 65 deg. C.

5. The process of claim 1, wherein said non-woven comprises polyester, polyethylene, polypropylene, cellulose, and mixtures thereof.

6. The process of claim 1, wherein said polymeric structuring agent comprises polyamides, block copolymers of ethylene oxide and propylene oxide having hydrophilic and lypophilic end groups, alkyl phenol polylower alkylene oxide lower alkanols, polymers of lower alkylene glycols, polyalkylene glycol ethers of higher fatty alcohols and poly alkylene glycol esters of higher fatty acids, polyoxyalkylenated fatty alcohols, polyurethanes, polylactide, polyacrylamide, polyacrylates, polyethylene, polyvinyl alcohol, and mixtures thereof.

7. The process of claim 1, wherein said matrix is substantially free from cationic surfactarit.

8. The process of claim 1, wherein the ratio of said anionic surfactant to said fatty acid to said non-ionic material is about 1/1.5/1 to about 1/2.5/2 by the weight.

9. The process of claim 1, wherein said solid or semi-solid matrix composition is cast into a bar of about 10 to about 30 grams.

10. The process of claim 1, further comprising providing a package for the fabric care article.

11. The process of claim 10, wherein said package retains said matrix therein and permits delivery of said matrix materials onto fabrics in a tumble dryer.

12. The process of claim 11, wherein said package controls the amount of said materials delivered onto said fabrics per cycle of said tumble dryer.

13. The process of claim 10, wherein said package is provided with a delivery window.

14. The process of claim 13, wherein said delivery window comprises a material that adsobs and/or absorbs said matrix materials during the operation of said tumble dryer.

15. The process of claim 14, wherein said sorptive material controls delivery of said matrix materials onto said fabrics.

16. The process of claim 14, wherein said sorptive material comprises non-woven material comprising polyester, polypropylene, cellulose, and mixtures thereof.

17. A method of fabric care comprising:

(a) preparing a fabric care article by the process of claim 1;

(b) placing the article in a machine tumble dryer;

(c) loading said dryer with damp laundered fabric; and (d) operating said dryer to achieve an elevated temperature of up to about 90 deg. C.; and repeating steps (c) and (d) multiple times.

* * * * *